US005738264A

United States Patent [19]

Jackson et al.

[11] Patent Number: 5,738,264

[45] Date of Patent: Apr. 14, 1998

[54] AUTOMATED FOLDER NIPPING ROLLER ADJUSTMENT

[75] Inventors: John C. Jackson; Peter A. Donaldson; Ian A. Sharples, all of Preston, United Kingdom

[73] Assignee: Goss Graphic Systems, Inc., Westmont, Ill.

[21] Appl. No.: 730,532

[22] Filed: Oct. 11, 1996

[51] Int. Cl.[6] ..... B65H 20/00; B65H 26/00

[52] U.S. Cl. ..... 226/177; 226/45; 226/100; 226/187

[58] Field of Search ..... 226/10, 65, 100, 226/176, 177, 187

[56] References Cited

U.S. PATENT DOCUMENTS

| | | | |
|---|---|---|---|
| 2,796,781 | 6/1957 | Mills | 226/176 X |
| 3,147,901 | 9/1964 | Nordman et al. | 226/176 |
| 3,625,509 | 12/1971 | Claybourn | 226/45 X |
| 3,964,657 | 6/1976 | Lenk et al. | 226/177 |
| 4,060,187 | 11/1977 | Grob | 226/177 X |
| 4,491,929 | 1/1985 | Ikoma et al. | 226/177 X |

*Primary Examiner*—Michael Mansen

*Attorney, Agent, or Firm*—Marshall, O'Toole, Gerstein, Murray & Borun

[57] ABSTRACT

Web feed apparatus, for example in web printing and folding apparatus, has a pair of opposing rollers, one (28) on a fixed axis and one (22) laterally movable to define an adjustable nip gap between their peripheries. The gap is automatically set and adjusted by a setting screw (4) driven by a servo motor (60) with rotation of the screw monitors by a potentiometer sensor (64). A stop collar (52) on the screw limits axial displacement thereof to determine the set nip gap and a spring (50) urges the rollers towards each other but permits displacement under overload conditions. A rectilinear sensor (54) senses said conditions by monitoring relative displacement of the stop collar and a programmable control system processes signals from the sensors and operates the servo motor accordingly.

12 Claims, 3 Drawing Sheets

AUTOMATED FOLDER NIPPING ROLLER ADJUSTMENT

BACKGROUND OF THE INVENTION

This invention relates to nip rollers forming part of continuous web processing apparatus, and more specifically to nip rollers used in web printing and folding apparatus.

Nip rollers are used in print web folders to draw the continuous printed paper (or any other web substrate) ribbons into the folding equipment. FIG. 1 illustrates a typical folder configuration. They are arranged in co-acting driven pairs 10 under each former plate 12, usually two pairs per plate plus a further pair 14 when substrate ribbons 16,18 from more than one former plate are to be collated together.

The requirement for paging variations, substrate calliper (thickness) variations and the sensitivity of these rollers with respect to substrate tension upstream of them demands that the nip gap between co-acting pairs be adjustable. Traditionally, the setting of these rollers has been done by operator "feel" usually using slip sheets, i.e. the required number of strips of the substrate to be printed. The elimination of this "feel" facility usually induces operational problems and consequently, operator resistance to the equipment. "Feel" also encompasses the operator's need to balance the tensions in multi-web (more than one printed web fed into the folding equipment) printing press operation.

There is a requirement within the user industry to increase equipment utilisation to which end machine down time could be reduced by automated setting procedures. It is already established that settings relating to the product being printed; format, imposition and page number can be driven from computer data bases containing such information. Nipping rollers have also to cope with substrate calliper variance and operator feel which are outside the scope of current imposition systems.

PRIOR ART

There are three basic systems in common use; pure variable pressure fluid (pressure only—no gap control) systems (eg pneumatic); sprung loaded gap control; and variable pressure fluid loaded (eg pneumatic) gap control. They are shown simplistically in FIGS. 2A, 2B and 2C respectively. The invention concerns only the latter two, the former being largely discredited with respect to substrate tension control. In a generic sense, the gap setting systems are adjustable stops 20 with the adjustable roller 22 spring 24 (FIG. 2*c*) or pneumatically 26 (FIG. 2*b*) loaded against the stops. In addition, the adjustable rollers are capable of movement against the load away from the stop in an overload situation. In these illustrated cases the rotational axis of one roller 28 of the pair is fixed, its co-acting mate 22 is mounted in levers 32 that can pivot about an axis 34 offset from, but parallel to the roller axis. Each adjustable roller of the systems shown in FIGS. 2B and 2C has an adjusting mechanism at each end of the roller.

SUMMARY OF THE INVENTION

A principle feature of the present invention is the provision of improved web feed apparatus incorporating nip rollers and in particular, provision of said apparatus having automated gap or nip adjustment facilitating setting up and tuning with consequent savings in plant down time and operator involvement.

The apparatus of the present invention comprises a control system including power drive means for selective adjustment of stop means limiting movement of a first roller of a nip pair towards the second roller thereof, determining the operative minimum nip gap; a first sensor operating to monitor said adjustment, a second sensor operating to monitor relative movement between the stop means and fixed mounting means caused by overload widening the nip gap from said minimum; and programmable setting means for receiving and processing signals from said sensors and regulating actuation of the drive means in response to those signals.

Other features of the invention will be apparent from the following description read in conjunction with the appended claims.

DESCRIPTION OF THE PREFERRED EMBODIMENT

Figure 2A:
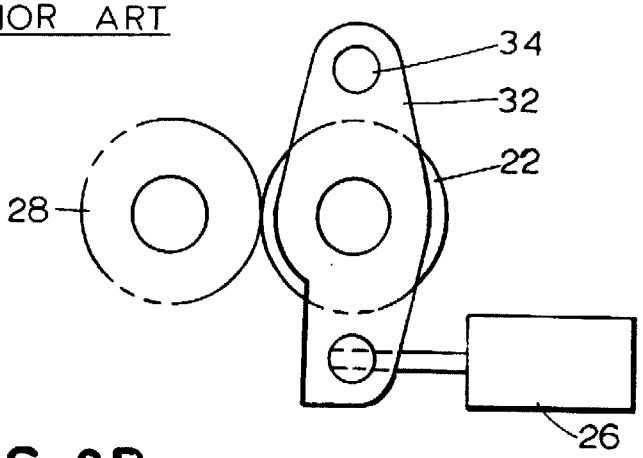
FIG. 2A PRIOR ART
FIGS. 2A, 2B and 2C are simplistic diagrams of prior art nip roller systems as described above.
Figure 2B:
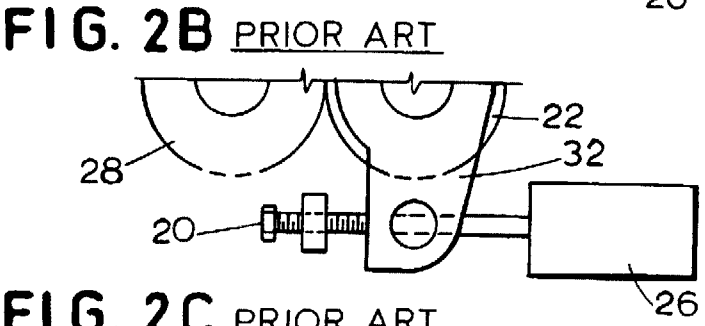
FIG. 2B PRIOR ART
Figure 2C:
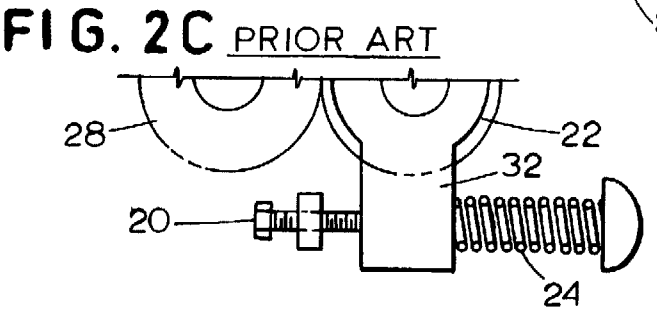
FIG. 2C PRIOR ART
Figure 1:
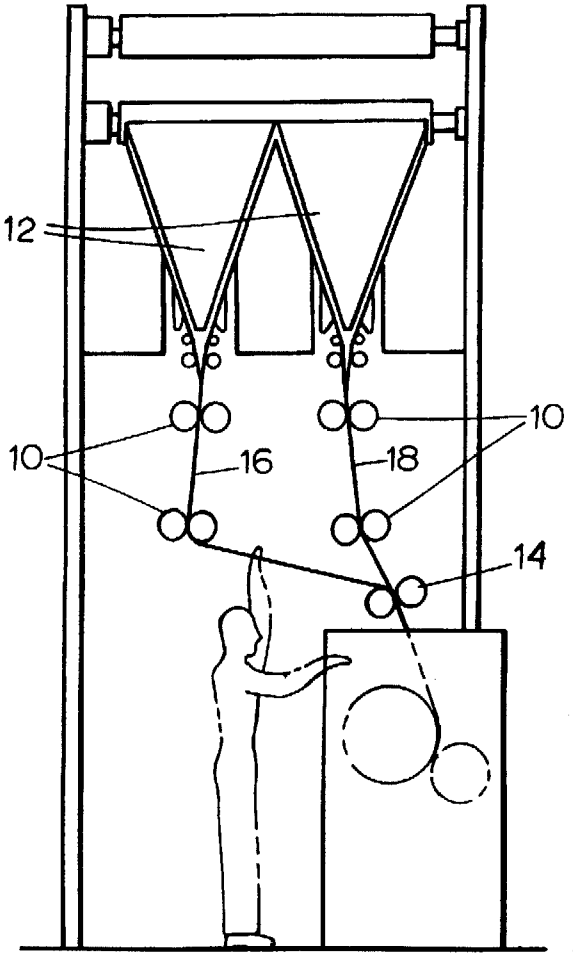
FIG. 1 PRIOR ART
FIG. 1 is a diagrammatic illustration of a typical folder configuration as referred to above.
Figure 3:
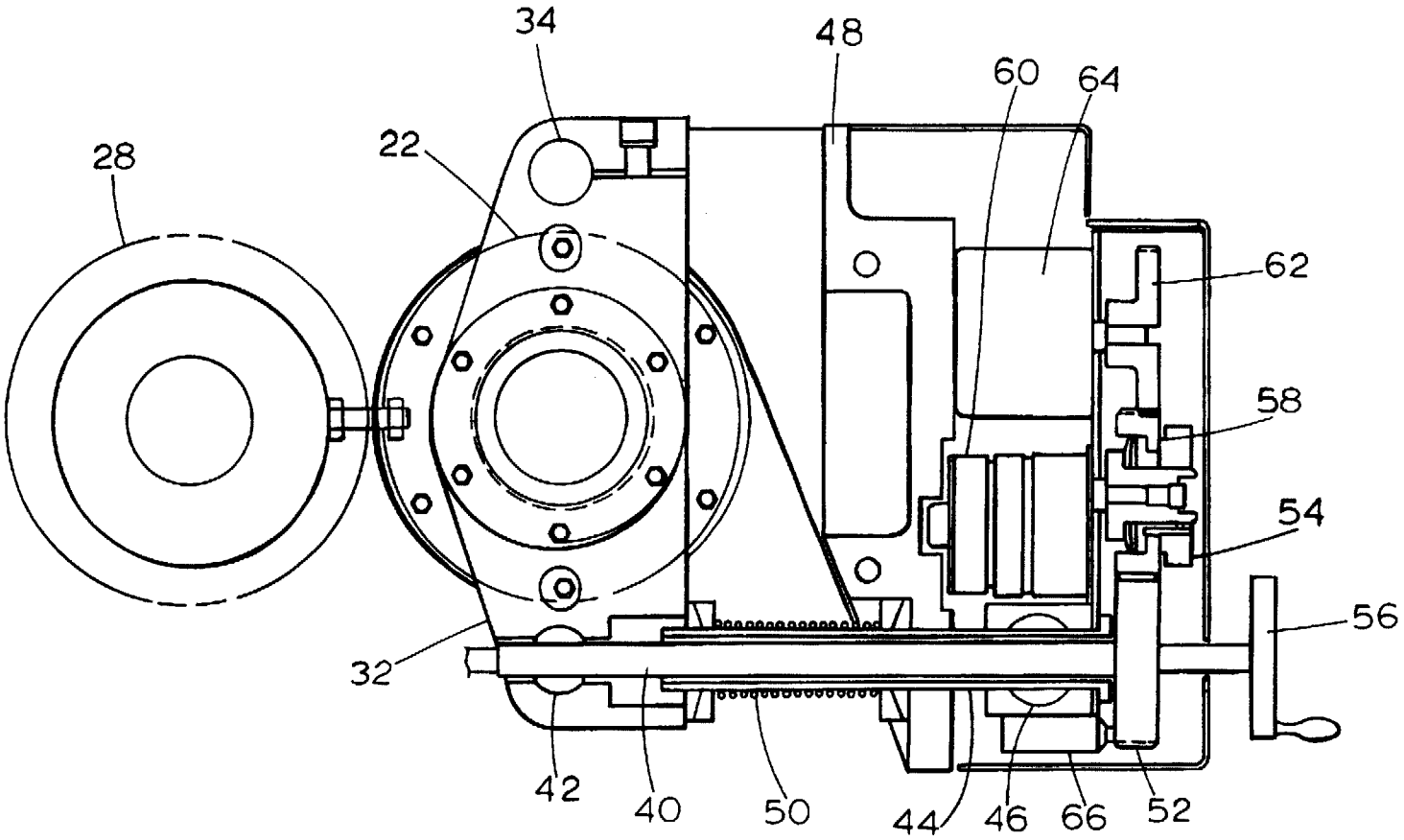
FIG. 3 is a part sectional side elevation of nip rollers and associated mechanism of feed apparatus embodying the invention.

Referring to FIG. 3 a pair of nip rollers 22, 28 are mounted as described with reference to FIG. 2, the lefthand roller 28 being journalled on a fixed axis and the right hand roller 22 being laterally adjustable relative thereto by being journalled in a pair of levers 32 (one only shown) pivoted at one end on axis 34 and provided with adjusting mechanism acting on their free ends.

Figure 4:
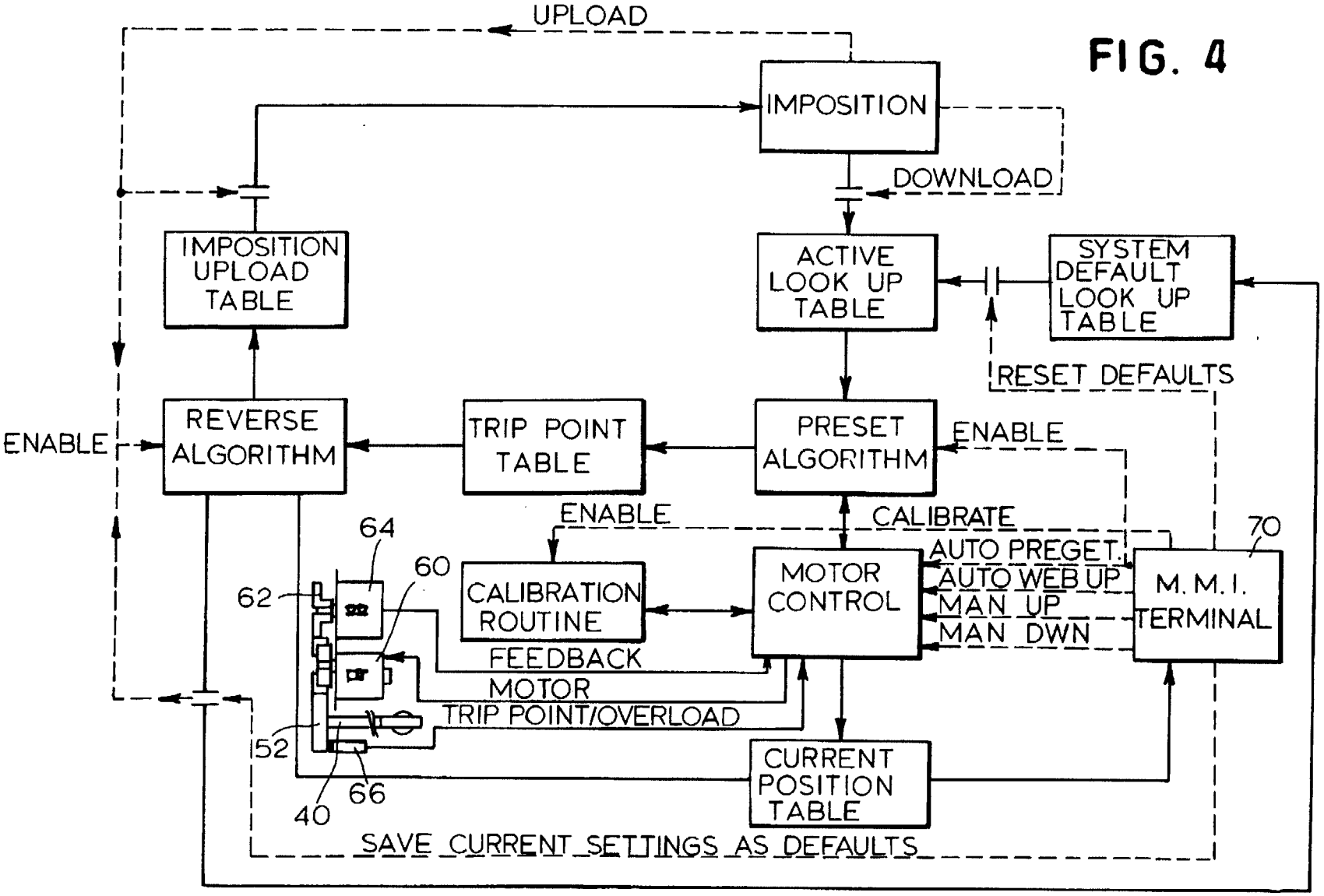
FIG. 4 is a block diagram of a control system of said apparatus.

The adjustment mechanism is capable of automatic presetting by being slave to a control system, for example as outlined in block diagram in FIG. 4.

FIG. 3 shows levers 32 resiliently loaded by compression springs 50 but it is to be understood that other resilient loading means could be employed, for example tension springs, or pneumatic or other fluid pressure devices.

The adjustment means comprises a male threaded adjusting screw 40 in threaded engagement with a female threaded bobbin nut 42 located pivotally in the free end of lever 32 allowing relative angular displacement but ensuring that any angular movement of the lever 32 about axis 34 causes axial displacement of screw 40.

The end portion of screw 40 remote from nut 42 is slidingly engaged through a bearing housing 44 mounted by way of a bobbin pivot 46 to the static machine frame 48.

Resilient loading means, in this example a compression spring 50 surrounding screw 40 and acting between lever 32 and bearing housing 44, urges roller 22 to the left as viewed in FIG. 3.

Stop means constituted by a stop collar 52 fast with screw 40 on the side of bobbin pivot remote from lever 32 co-acts with a thrust bearing 54 of housing 44 to limit leftward axial displacement of screw 40 and consequently determine the nip gap between the rollers, the setting being adjusted by rotation of screw 40.

As thus far described the arrangement shown in FIG. 3 corresponds in function to that shown in FIG. 2C.

A handwheel or crank handle 56 may be provided on the free end of screw 40 for manual rotation of the latter, however, the invention contemplates that setting up and running adjustment of the nip gap by operation of screw 40 will be monitored and controlled automatically.

Stop collar 52 has spur gear teeth cut in its periphery which mesh with an output pinion 58 driven by a reversible electric servo motor 60 mounted on frame 48.

Pinion 58 also meshes with a further spur gear 62 providing input to a rotary position sensor in the form of a rotary potentiometer or encoder 64 which provides positional feedback of rotation of screw 40 to the control system. The use of straight spur gearing permits axial displacement of stop collar 52 along with screw 40 in an overload or similar condition in which roller 22 is shifted to the right under forces overcoming the pressure of spring 50. It will be noted that any manual adjustment of screw 40 will be sensed by encoder 64 and read into the control system.

The loading of the components by the action of spring 50 also takes up any slack or play to ensure positive location of roll 22 in relation to stop collar 52 and its abutment with thrust bearing 54.

An analogue rectilinear position sensor 66 secured to bearing housing 44 and having a probe bearing against the side face of stop collar 52 monitors any axial displacement of the latter away from thrust bearing 54 as caused by an overload condition, for example a paper jam or the like widening the nip. Such displacement is thereby also read into the control system. An analogue sensor is specified to facilitate sensor calibration in the control system software to allow for sensor gap setting variants. In this example the control system is configured to signal a trip point on axial displacement of stop collar 52 in excess of 0.1 mm; and a jam point if said displacement exceeds a minimum travel some distance beyond the trip point.

FIG. 4 outlines the control system. The system provides for individual roller pair or collective adjustment of more than one pair of rollers. The system interfaces can be divided into three groups; those to the mechnism's hardware, those to the operator's machine control panel and those to the parent machine's control system.

Under 'web up' mode, the system sets the movable nip roller 22 at 0 (zero) feedback from the potentiometer 64; this ensures positive pull on the loose webs being fed into the folder. As the number of webs entering the nip increases, the control system maintains the trip point such that when webbing up is completed, set up time is minimised.

The system is designed so that, when an operator initiates a 'gap setting' mode, it first checks the status of the screw position sensor 66; if not on the trip point, then the system will first drive motor 64 shift screw 40 to the trip point. The system is now ready to proceed with presetting the nip roller gap Motor 60 is activated to "open" the screw a distance defined by an algorithm relating the paper or other web thickness to the desired pressure. The nip rollers are now preset.

Once preset, the system allows for "tuning" adjustments via the manual open/close controls on a man-machine interface (MMI) 70 or via handwheel 56, if provided. In addition, the system provides for gap setting feed-back to MMI 70 in the form of a read-out from the rotary potentiometer or encoder 64 irrespective of preset values. If sufficient relative axial movement of screw 40 is induced for a sufficient period of time, by whatever means, it will be interpreted by the system as an overload and will consequently stop the machine via its parent control system.

From the parent control system under password access, an operator can check or adjust the distance each motor 60 reverses once the related analogue proximity sensor 66 has opened. Since these values will in the main be empirical, this will address the need for operator "feel" Also from the parent control system but under a higher hierarchy password access, an engineer can set, check or adjust the analogue position sensor 66 calibration and/or set, check or adjust the rotary potentiometer or encoder 64 calibration.

The main program will take all the parameters required for its operation from a look up table, which will be loaded with default values by a sub routine which will execute on the first processor scan. All data required by MMI terminal 70 will be moved to and/or from a contiguous data file which will represent a data image file for the MMI terminal.

Motor 60 will be driven from two pairs of outputs cross wired to allow inversion of supply phases for reversal of the motor. The outputs will be energised in opposing pairs to provide the correct supply phasing for the required motor direction. The outputs will have a 10 ms delay applied to them, this value will be stored in the look up table. This is to allow the other pair of outputs, if previously enabled, time to turn off thus preventing short circuit of the motor supply. The motor drive output pairs will also be interlocked to prevent them from attempting to energise at the same time.

The analogue input signals will be scaled and will have a dead band applied to them to prevent the system from hunting, the value of which will be stored in the look up table.

The value for amount by which roller 22 must move away from roller 28 before a Jam Detected signal is sent to the drive is stored in the look up table, when this value is reached or exceeded a timer is triggered. If the roller does not return to a position less than this value before the timer times out a Jam Detected bit will be set on the press interface output module. The timer is used to remove the possibility of small creases causing false triggering of the jam detection system and the period value of the timer will be stored in the look up table.

The 'feel' value which will be used during automatic operation of the system will be stored in the look up table. When the system is in auto preset mode and the trip point is reached this value is applied to the 'gap calculation algorithm' which uses this value along the trip point and various other parameters to calculate how much the nips should be backed off for a specific 'feel'. The current 'feel' value must be available to the imposition system and this will be achieved by reversing 'gap calculation algorithm' and providing a table of 'feel' values for the imposition which ill be passed by setting an 8 bit data word on the press interface output module to the current value. The 'feel' set-point value must also be pre-settable by the imposition system and this will be achieved by the imposition system setting an 8 bit word on the press interface input module to the required value and then passing it to the current look up table. Additional control and handshaking bits will be provided for the imposition system. The 'feel' values can be stored as defaults from a password protected menu on MMI terminal 70.

Motor 60 or the motor of any other pair of rollers can be manually adjusted from MMI 70 terminal by incrementing or decrementing the displayed value with +and–buttons.

The system will have a factory calibration applied to the software on manufacture and from then on will be self calibrating. This is achieved by winding roller 22 to known positions and calculating the calibration offset.

The system is also self configuring, the only setting up for different configurations of rollers required is to assign a value to a 16 bit data word corresponding to the configuration required. The system will then configure the I/0 and display accordingly. When the system is first started it will load a set of factory default values which should provide a starting point for the end user.

What is claimed is:

1. Feed apparatus for transport of continuous web material including:

(a) first and second nip rollers disposed in coacting peripheral relationship and operatively driven for controlled feed of the web material therebetween;

(b) means mounting the first roller for lateral displacement relative to the second roller;

(c) adjustable stop means co-acting with said mounting means to limit movement of the first roller towards the second roller and so determine the operative minimum nip gap between said peripheries; and (d) resilient means urging the mounting means towards engagement with the stop means under predetermined loading so permitting the nip gap to increase when an overload condition occurs:

wherein the improvement comprises a control system including power drive means for selective adjustment of the stop means, a first sensor operation to monitor said adjustment, a second sensor operating to monitor relative movement between the stop means and mounting means, and programmable setting means for receiving and processing signals from said sensors and regulating actuation of the drive means in response to those signals.

2. Apparatus as in claim 1 wherein the stop means includes a screw threaded adjustment device and the power drive means includes a rotary electric motor selectively driving said device to effect adjustment of the first roller limit position.

3. Apparatus as in claim 2 wherein the first sensor is a rotary electrical potentiometer driven by said motor in common with the adjustment device.

4. Apparatus as in claim 2 wherein the first sensor is a rotary electrical encoder driven by said motor in common with the adjustment device.

5. Apparatus as in claim 2 wherein said adjustment device comprises a threaded nut carried on the first mounting means, an adjustment screw in threaded engagement with the nut and axially displaceable in a fixed journal remote from the nut, and a stop collar fast with the screw on the side of said journal remote from the nut, the stop means consisting of said collar and its abutting relationship with the journal.

6. Apparatus as in claim 5 wherein the stop collar is provided with spur gear teeth on its periphery drivingly engaged by a pinion driven by said electric motor, said teeth permitting axial displacement of the stop collar relative to the pinion.

7. Apparatus as in claim 5 wherein the resilient means is a compression spring acting in parallel with the adjustment screw between said threaded nut and said fixed journal.

8. Apparatus as in claim 5 wherein the second sensor is an analogue position sensor responsive axial displacement of the stop collar relative to the fixed journal.

9. Apparatus as in claim 8 wherein the control system is configured to sense a trip point when said relative movement exceeds a first predetermined minimum and to sense a jam point when said movement exceeds a second and greater predetermined minimum.

10. Apparatus as in claim 1 including manually actuable setting up means enabling manual adjustment of the stop means.

11. Apparatus as in claim 1 wherein the control system further includes a timer and preprogrammable logic means initiating a jam detected mode if the timer records that the second sensor has detected continued displacement of the stop means for more than a predetermined period.

12. Apparatus as in claim 1 wherein the control system includes preprogrammable logic means for automatic presetting of the nip rollers with the inclusion of a pre-recorded feel valve backing off operative roller nip pressure by a predetermined factor.

* * * * *